US007970158B2

(12) United States Patent
Hoglund

(10) Patent No.: US 7,970,158 B2
(45) Date of Patent: Jun. 28, 2011

(54) SOUND SYSTEM

(76) Inventor: Lennart Hoglund, Linkoping (SE)

( * ) Notice: Subject to any disclaimer, the term of this patent is extended or adjusted under 35 U.S.C. 154(b) by 1188 days.

(21) Appl. No.: 11/569,672

(22) PCT Filed: May 25, 2005

(86) PCT No.: PCT/SE2005/000772

§ 371 (c)(1),
(2), (4) Date: Nov. 27, 2006

(87) PCT Pub. No.: WO2006/004476

PCT Pub. Date: Jan. 12, 2006

(65) Prior Publication Data

US 2007/0223729 A1 Sep. 27, 2007

(30) Foreign Application Priority Data

May 28, 2004 (SE) ..... 0401365

(51) Int. Cl.
*H04R 9/06* (2006.01)

(52) U.S. Cl. ..... 381/335; 381/336; 381/342; 381/412; 381/420; 381/421; 381/345; 381/386; 381/387; 381/182; 381/186; 181/176; 181/163; 181/199

(58) Field of Classification Search ..... 381/304–305, 381/87, 335–336, 89, 345, 160, 342, 412, 381/420–421, 386–387, 182, 186; 181/176, 181/163, 199

See application file for complete search history.

(56) References Cited

U.S. PATENT DOCUMENTS

| | | | | |
|---|---|---|---|---|
| 2,632,055 | A | 3/1953 | Parker | |
| 3,980,829 | A * | 9/1976 | Beveridge | 381/305 |
| 4,753,318 | A * | 6/1988 | Mizuno et al. | 181/204 |
| 4,860,363 | A * | 8/1989 | Suzuki et al. | 381/89 |

FOREIGN PATENT DOCUMENTS

| | | |
|---|---|---|
| DE | 3502921 | 7/1986 |
| DE | 4426995 | 1/1996 |
| DE | 10008356 | 9/2001 |
| GB | 2256773 | 12/1992 |
| SE | WO01/65890 | 9/2001 |

* cited by examiner

*Primary Examiner* — Devona E Faulk
*Assistant Examiner* — Disler Paul
(74) *Attorney, Agent, or Firm* — Fasth Law Offices; Rolf Fasth

(57) ABSTRACT

A long and narrow loudspeaker on an entire wall gives off a cylindrical wave, which covers the entire room. Extra loudspeakers fixed at an angle against the wall will be heard in another direction, producing angle stereo independent of where one is in the room. Electro-dynamic loudspeakers are made of long plates of iron with air gapes between them where magnetic fields are produced. In the air gaps are strips, which conduct the sound currents. The strips influence directly one or more membranes. The magnetic field can be produced by permanent magnets, electromagnets or through concentration of geomagnetic fields. Long loudspeakers, which use other forces such as electrostatic forces, only need to be made for small sound pressure at the membrane.

9 Claims, 1 Drawing Sheet

SOUND SYSTEM

PRIOR APPLICATION

This application is a U.S. national phase application based on International Application No. PCT/SE2005/000772, filed 25 May 2005, claiming priority from Swedish Patent Application No. 0401365-2, filed 28 May 2004.

Too much sound produced today cause damage to the ear. In the ear there are muscles which can be tired. Therefore, after a period of exposure, injures may arise from reasonable high sound levels.

The aim is to produce a sound system which with high quality only give off the sound level needed at all places in the whole space intended.

A long and narrow loudspeaker along a whole wall has the following advantages:

The listeners closest to the sound system are all exposed to the same sound levels. No or only insignificant reflections arise from the side walls if the room has right angles in the corners.

The sound pressure drops relatively slowly so that listeners at distance from the loudspeaker maintains a good sound level without the nearest listeners having to be exposed to painfully high levels.

A section of the loudspeaker only needs to deliver sound to a slice of air in front of the section, which means that the membrane only needs to deliver relatively low sound pressures, which imply small amplitudes.

The air retains its linear properties, so distortion caused by high sound pressure does not occur. The sound coil movement gets small amplitude, so that the distortion in the driving system will be low.

If one want to further improve the propagation of the sound, it can be relatively easily reflected and bent because the material for this will have cylindrical surfaces. Driving systems with reduced force may be used e.g. reduced magnetic field in electro-dynamic driving system. Even geomagnetic fields may be used if they are at first concentrated.

SHORT DESCRIPTION OF THE FIGURES

Figure 1:
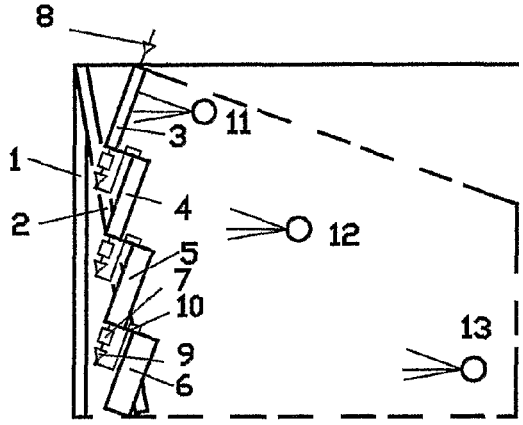
FIG. 1 shows three horizontally placed long and narrow loudspeakers on a wall, which produce angle stereo in the entire room.

FIG. 1 shows a long, narrow loudspeaker 1 on a wall. The loudspeaker follows the wall and gives off the sound in a straight forward direction. The loudspeaker 2 has the left end moved forward, causing the sound to be somewhat directed to the right. This gives a stereo sound with two distinct directions as to where the sound is coming from and is much more independent of ones location in the room than would be expected using concentrated loudspeakers.

If the loudspeakers encroach on the space one can mount loudspeaker elements 3, 4, 5 and 6 directed in the same angle but in a row against the wall. These elements are in themselves long and narrow loudspeakers, which means that the membrane is long and narrow. The sound is delayed between the loudspeaker elements with e.g. an electronic delay 7 between them, so that the wave front is straight but directed obliquely forward. The signal enters the first element by an amplifier 8 and to every element there are suitable amplifiers 9. Between the elements there is a partition wall 10. All the listeners 11, 12 and 13 now receive a sound source coming from the right. In order to more exactly adapt the waves between the elements they can be made with different widths.

Figure 2:
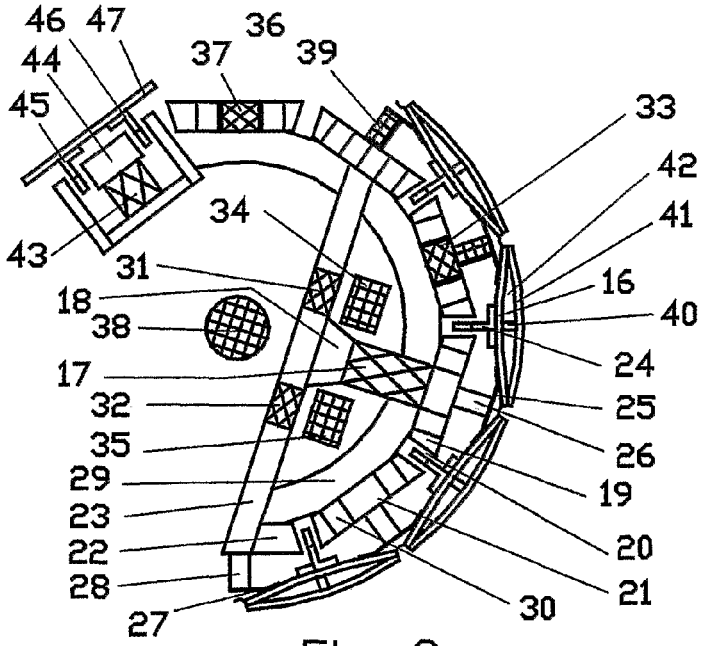
FIG. 2 shows a side-view of an example of a horizontally placed long and narrow loudspeaker composed of a number of membranes which together form a half cylinder and a speaker with only one membrane.

It is quite easy to increase the distribution of sound from a long and narrow loudspeaker, even to the extent that it becomes circular, which is shown in FIG. 2 as a cross-section. There are at first long parallel membranes 16, which direct the sound respectively in their own direction. A long preferable permanent magnet 17 feed its flux from its own long side, which lies against the one side on an equally long flux distributing rod 18, to the middle line on an oblique made thin side of a long plate 19. Half the flux goes via one slanting edge and an air gap 20 to a similar long plate in a similar position, but slightly rotated, forming an air gap of uniform width. The magnetic field goes out through the other slanting edge and passes a similar air gap to a profiled long plate 22 also with slanting edges. The other slanting edge of the profiled long plate 22 faces in the same direction as the others side of the flux distributing rod 18, making it possible for the square rods 23 to pass, without air gaps, the magnetic field to that side and close the magnetic field.

Even the other slanting edge of the long plate 19 on the permanent magnet has a similar magnetic circuit, whose magnetic field is fed back via the other ends of the square rods 23.

In the air gaps there are conductors formed as T-profiles 24 with slits in the roof of the T, in order to prevent current from passing there. The roof of the T-profiles are fastened to the membranes 16, whose edges with elastic strips 25 are affixed in supports on the outside of the long plate 19. The outermost strips 27 are affixed in nonmagnetic struts 28 on the ends of the square rods 23.

The sound currents are fed into the upper conductors and return through the lower conductors.

The permanent magnets can be placed anywhere in the magnetic circuits e.g. two permanent magnets 31 and 32 in the square rods or an permanent magnet 33 in the long plates 19 with bevelled sides.

The magnetic flux can also be obtained by an electric current, which goes in a coil, which goes longitudinally around the profiled flux distributing rod 18, and has the cross section 34 and 35.

The construction principle is flexible, so that a round propagating loudspeaker, which e.g. can go from floor to ceiling, is illustrated by an arch 29, which is joined to a ring, on which many long plates with bevelled sides are fixed. How the construction is continued may be easily perceived and continues in the upper part 36, but is broken by an example of a simple element, which will be described later. In the round propagating loudspeaker the permanent magnets 37 can be placed in the long plate 19 or a form of torus coil can be used going from the center with the cross-section 38 and back into the supports with the cross-section 39. The sound currents then goes through the conductors and returns in the long plate 19.

The membranes can be made stiff by building them as trusses. The membrane 16 can be made bent by placing a beam 40 outside the center line and a further plate 41 upon and fixed to the longitudinal edges of the plates. It may also be placed ribs 42 between the plates.

The mentioned simple loudspeaker has a permanent magnet 43, which forces the magnetic field across into an iron rod 44 and out into two parallel air gaps at the sides. In the air gaps there are conductors of L-profiles 45 and 46 with slits in the joins to a plane membrane 47. The magnetic field returns with the mentioned iron structure, which let the sound waves pass. Many loudspeakers can form a cylinder.

A long and narrow loudspeaker, which uses the geomagnetic field will be effective because the magnetic field can be concentrated. Furthermore, the sound pressure can be amplified by a cylindrical exponential horn.

Figure 3:
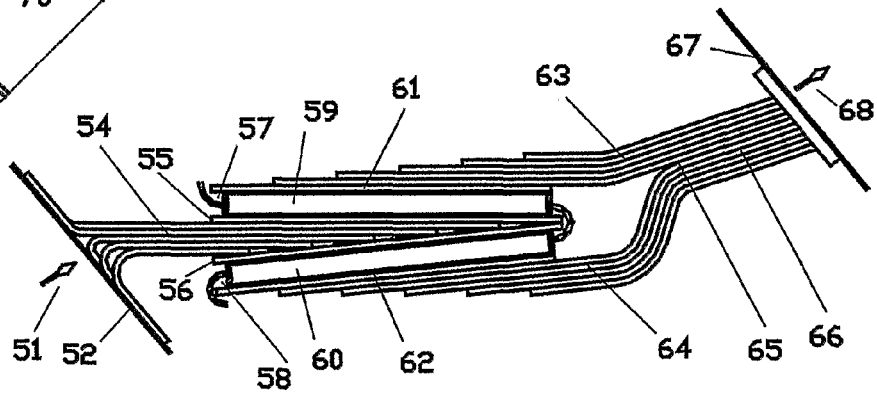
FIG. 3 shows how a long loudspeaker is made of flux catchers of iron plates, which catch geomagnetic fields and via flux conductors distribute the field across long membranes, which conduct the sound current.

In detail the loud speaker can be made e.g. as on FIG. 3. The earth's magnetic field 51 is caught by a first flux catcher 52, which consists of an iron plate. The flux conductor 54 conveys the magnetic field to flux plates 55 and 56 where the flux conductor is of decreasing thickness. The magnet field passes air gaps 57 and 58 in which horizontal membranes 59 and 60 are placed and reaches the flux plates 61 and 62. There the flux goes over to flux conductors 63 and 64 so that in junction 65 they combine and head towards the flux conductor 66. This goes to a second flux catcher 67 from which the magnetic field 68 exits. The membranes are fed with longitudinal sound currents. The flux catcher can be placed on walls, roofs, masts, in the ground, in wells and mining holes.

This loudspeaker can above all be used where flux unintentionally has arisen. Railway rails in combination with steel roofs over platforms provide the possibility to give the travelers information, which they interpret as coming from an accompanying guide. Also natural flux catchers like ore are usable.

Figure 4:
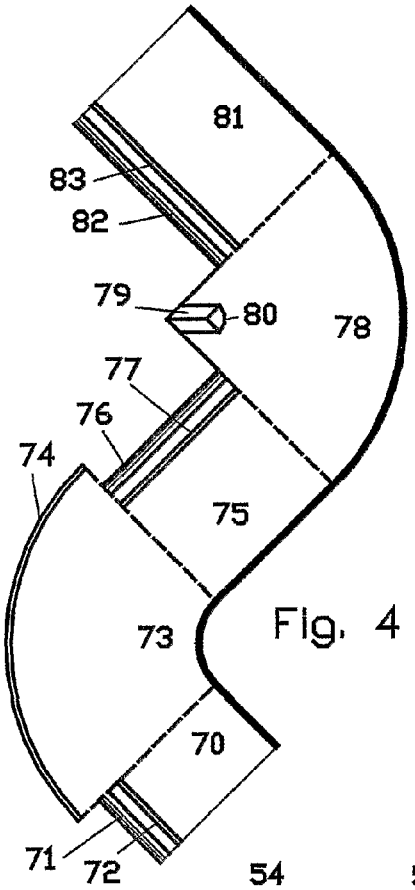
FIG. 4 shows how long, narrow and bent loudspeakers placed along and across walls in a winding passage give winding phase front but yet smooth, sound level, which reduce strong and unnecessary scattering

One method to combine sound in a broad corridor with both curves and straights is shown in FIG. 4. The corridor begins lowest down with a straight part 70, where a cylindrical, parabolic reflector 71 is placed on the left wall with a straight loudspeaker 72 in the focus line. Where the corridor turns to the right 73 there is a long bent loudspeaker 74 built of weakly bent or straight loudspeaker element. A straight loudspeaker would produce a sound level, which decreases with distance. The bending focuses the sound, giving a constant sound level at least within a certain range, which better fits with the plain wave in the earlier part 70, but also to the next part 75, which is straight and has a cylindrical, parabolic reflector 76 and a long loudspeaker 77 to the left.

The next part 78 has a curve to the left. There situated to the left is a long forward bent loudspeaker 79 with e.g. a quarter of a circle rounded membrane 80 and concentrates the sound a distance out from the opposite bent wall, making the sound level almost constant.

The almost constant sound level fits to the plane wave in the straight part 75, but also to the last part 81, which is straight and has a cylindrical, parabolic reflector 82 and a straight loudspeaker 83 to the left.

Figure 5:
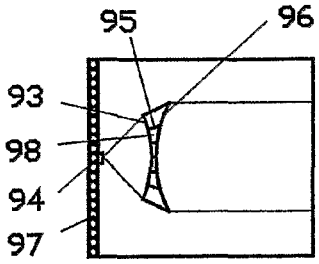
FIG. 5 shows how an anisotropic prism redirects sound.

Sound can in principal be focused through a prism where the material is within special cylinders with arces as generatrixes. The aim can also be to guide away sound e.g. if it is disturbing. Then the cross-section of the prism can be triangular. The acoustic lens can be made of cellular plastic. This is an isotropic material. An acoustic lens where the material is anisotropic, guides the sound better in the desired direction as opposed to perpendicular to it, as shown in FIG. 5. As seen from the perspective of the loudspeaker. It is built of a large convex cylindrical membrane 93, which receives the sound waves from a long and narrow loudspeaker 94 and guides the sound forward by sound conductors 95 of e.g. plates, rods, tubes, grinders or beams to a concave cylindrical membrane 96. Because the sound conductors are longer against the edges of the membrane and the sound velocity in those are higher than in the air, the wave front will be changed from cylindrical to e.g. plain when it propagates out in the air.

It is not possible to prevent the sound from also reflecting from the acoustic lens. If there is a wall behind the loudspeaker it may be necessary to provide it with sound damping material 97. Separately carried sound damping material 98 in the cells between the membranes can be an advantage.

While the present invention has been described in accordance with preferred compositions and embodiments, it is to be understood that certain substitutions and alterations may be made thereto without departing from the spirit and scope of the following claims.

The invention claimed is:

1. A sound system for rooms comprising:

one or many long and narrow loudspeakers with membranes essentially along its entire length, extending between limits which in the room are essentially from wall to wall or floor to ceiling and that the sound is improved by prisms and cylindrical mirrors and lenses;

a loudspeaker having a magnetic circuit, which forces a flux across a number of plates with slanted edges, whose edges transfer the magnetic field by plane air gaps to each other and make a cylinder with an arch formed generatrix, whose cylinder edges close the magnetic field by a structure of iron and has got its magnetic field in a known way; and conductors of strips with the one edge lying in the air gaps and the other edge provided with fingers made by slits in order to prevent sound current from going outside the air gap;

and long membrane structures, which are fixed to the strips by the fingers and which structures consists of bent plates with beams in between and ribs of light material.

2. A sound system according to claim 1 characterized by the fact that the room is a large space, which is covered by essentially cylindrical waves from one or many long and narrow loudspeakers, at which the room is limited of the wave itself, gables on the loudspeaker system, scenes left side to right side, arenas border, narrowing and expanding rooms at which the loudspeakers are bent, but which also are without real limitations in the length direction of the loudspeakers by going in closed rings.

3. A sound system according to claim 1 characterized by loudspeakers in composed rooms are made long and inwardly bent so that they, together with straight loudspeakers, produce sound which have continuous phase fronts.

4. A sound system according to claim 1 wherein the loudspeakers sit essentially in the line of focus behind an acoustic lens of a first membrane, which receives the sound waves and guides the sound to a second membrane by sound conductors of plates, rods, tubes, trusses, or beams and that the space in between contains separately carried sound damping material.

5. A sound system according to claim 4 characterized by lenses and prisms with the same building technology redirect sound and attenuate and redirect noise.

6. A sound system according to claim 1 wherein each loudspeaker has a membrane extending along an entire length of each loudspeaker.

7. A sound system according to claim 1 wherein the system comprises an electrodynamic loudspeaker having an elongate perpendicularly magnetized permanent magnet.

8. A sound system according to claim 1 wherein the system comprises a loudspeaker having an elongate membrane that is driving an elongate acoustic impedance adapter.

9. A sound system according to claim 1 wherein the loudspeakers and the loudspeaker elements are approximated as long and narrow by using a row of separated loudspeakers.

* * * * *